US011926456B2

(12) United States Patent
Chen

(10) Patent No.: US 11,926,456 B2
(45) **Date of Patent: *Mar. 12, 2024**

(54) RECONFIGURABLE CONTAINER-CLOSURE SYSTEM

(71) Applicant: ELC MANAGEMENT LLC, Melville, NY (US)

(72) Inventor: Yun Chen, Shanghai (CN)

(73) Assignee: ELC Management LLC, Melville, NY (US)

( * ) Notice: Subject to any disclaimer, the term of this patent is extended or adjusted under 35 U.S.C. 154(b) by 298 days.

This patent is subject to a terminal disclaimer.

(21) Appl. No.: 17/598,869

(22) PCT Filed: Apr. 10, 2019

(86) PCT No.: PCT/CN2019/080336
§ 371 (c)(1),
(2) Date: Sep. 28, 2021

(87) PCT Pub. No.: WO2020/206570
PCT Pub. Date: Oct. 15, 2020

(65) Prior Publication Data

US 2022/0153490 A1 May 19, 2022

(51) Int. Cl.
*B65D 51/28* (2006.01)
*B65D 81/32* (2006.01)

(52) U.S. Cl.
CPC ..... *B65D 51/2878* (2013.01); *B65D 81/3216* (2013.01)

(58) Field of Classification Search
CPC ..... B65D 51/2878; B65D 81/3216; B65D 81/32; B65D 51/2864; B65D 51/2857; B65D 51/28

(Continued)

(56) References Cited

U.S. PATENT DOCUMENTS 7,055,685 B1 * 6/2006 Patterson ..... B65D 51/2892 215/DIG. 8
2005/0211579 A1 * 9/2005 Makita ..... B65D 51/2842 206/219

(Continued)

FOREIGN PATENT DOCUMENTS

CN 108792257 A 11/2018
CN 108861121 A 11/2018

(Continued)

OTHER PUBLICATIONS

EP Supplementary European Search Report; EP Application No. 19924130.8; dated Mar. 4, 2022.

(Continued)

*Primary Examiner* — Steven A. Reynolds
(74) *Attorney, Agent, or Firm* — Peter Giancana

(57) ABSTRACT

A reconfigurable container-closure system is comprised of first (10) and second containers (110) and first (12) and second closures (112). The container-closure system can assume either of two configurations. The first configuration means that the first closure (12) is secured to the first container (10), and the second closure (112) is secured to the second container (110). Also, an orifice reducer, cartridge and piston are all attached to the second closure (112), and two products are separated. Second configuration means that the second closure (112) is secured to the first container (10), and the first closure (12) is secured to the second container (110). Also, the orifice reducer, cartridge and piston are all attached to the first container (10), and two products are allowed to mix and be dispensed. The transfer is accomplished by a user who simply screws the second closure (112) onto the first container (10).

3 Claims, 13 Drawing Sheets

(58) Field of Classification Search
USPC ..... 206/219, 222
See application file for complete search history.

(56) References Cited

U.S. PATENT DOCUMENTS

| | | | | |
|---|---|---|---|---|
| 2006/0260959 | A1 | 11/2006 | Patterson et al. | |
| 2008/0202950 | A1* | 8/2008 | Anderson | B65D 51/2842 215/11.1 |
| 2009/0057262 | A1 | 3/2009 | Cho | |
| 2010/0025268 | A1* | 2/2010 | Lee | B65D 81/3222 220/521 |
| 2012/0000880 | A1* | 1/2012 | Im | B65D 51/2864 215/316 |
| 2016/0368661 | A1* | 12/2016 | Moore | B65D 47/089 |
| 2020/0156823 | A1* | 5/2020 | Hon | A45D 34/00 |
| 2022/0152490 | A1* | 5/2022 | Cerny | H04L 67/1095 |
| 2022/0153490 | A1 | 5/2022 | Chen | |

FOREIGN PATENT DOCUMENTS

| | | | |
|---|---|---|---|
| CN | 113891666 | A | 1/2022 |
| JP | 2022-528907 | A | 6/2022 |
| WO | WO-2020/206571 | A1 | 10/2020 |

OTHER PUBLICATIONS

China International Search Report from CN Application No. 201980095325.3; dated Dec. 12, 2022.
China Search Report from CN Application No. 201980095373.2; dated Aug. 26, 2022.
EP Supplementary European Search Report; EP Application No. 19923921.1; dated Mar. 3, 2022.
PCT International Search Report; International Application No. PCT/CN2019/080365; dated Dec. 23, 2019; Mailing Date: Jan. 21, 2020.
PCT Written Opinion of the International Searching Authority; International Application No. PCT/CN2019/080365; dated Dec. 23, 2019; Mailing Date: Jan. 21, 2020.

* cited by examiner

RECONFIGURABLE CONTAINER-CLOSURE SYSTEM

FIELD OF THE INVENTION

The invention is in the field of containers and closures for holding two compositions which remain separated until the time of first use. Applications include, but are not limited to, the field of personal care and cosmetic products.

BACKGROUND OF THE INVENTION

Multi-compartment container systems, in which two or more compositions or ingredients are maintained in a separated state until use, are known. Frequently, these are used to keep two or more ingredients from reacting until the time of first use by a consumer. In some situations, the reaction is designed to provide some benefit to the consumer, but should not be initiated until the consumer is about to use the product. In other cases, the reaction would be detrimental to one or more characteristics of the product. For example, a chemical composition may include an ingredient, the efficacy or potency of which is degraded with time as a result of factors in the environment in which the ingredient is dispersed. In this case, to ensure that an efficacious amount of the ingredient remains in the composition by the time the consumer uses the product, a formulator may include more of the ingredient than is really needed by the consumer. This is an obvious disadvantage, as the ingredient may be expensive or the degraded ingredient may further disturb the chemical composition. Thus, it would be advantageous if the ingredient could be protected from degradation until the time of first use by the consumer, and a multi-compartment container may be the answer. Also, there may be other reasons for wanting to maintain one or more ingredients separate from a main composition until the time of first use, and multi-compartment containers have been used for such purposes. Nevertheless, a reconfigurable multicompartment container-closure system like the invention described, herein, was unknown until now.

SUMMARY OF THE INVENTION

A reconfigurable container-closure system according to the invention comprises a first container (10) and a second container (110). The first container has a first reservoir (10*e*) with a first flowable product (20) located therein. A first closure (12) is able to form a fluid tight seal with the first container and with the second container. A second closure (112) is sized to engage the second container, but not necessarily make a fluid tight seal therewith, as well as form a fluid tight seal with the first container. A second reservoir (114*e*) is initially associated with the second closure, and has a second flowable product (120) located therein. The container-closure system is such that when the second closure (112) is made to form a fluid tight seal with the first container (10), the second reservoir (114*e*) becomes attached to the first container, which enables the second product (120) to mix with the first product (20). Also, when the second closure (112) is removed from the first container (10), the second reservoir (114*e*) remains attached to the first container. Thus, the mixing of the two products is accomplished by a user who simply screws the second closure onto the first container.

DETAILED DESCRIPTION

Throughout, the term "comprises" means that a list of features may not be limited to those explicitly recited, but may include additional features, as well.

Figure 1:
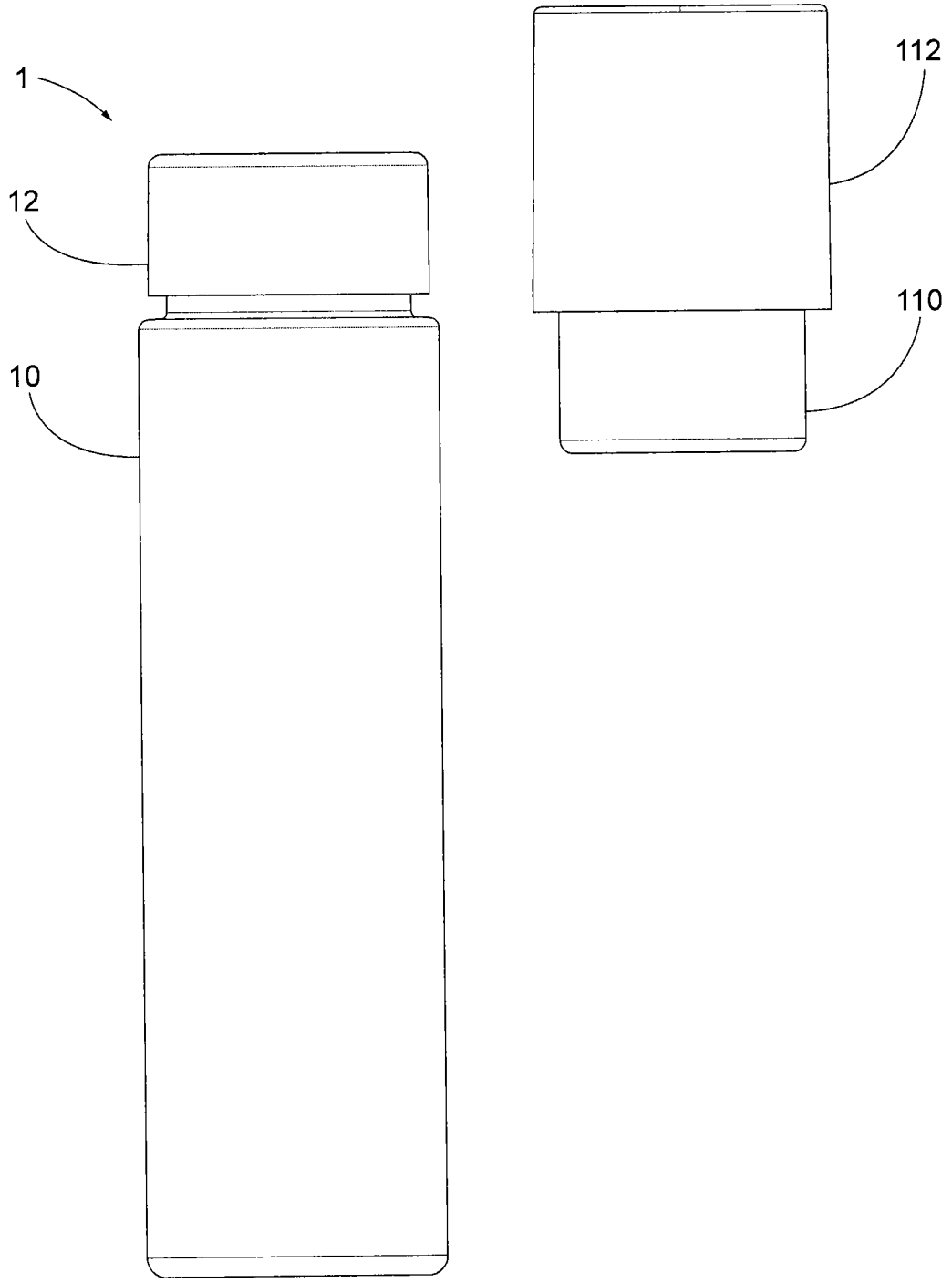
FIG. 1 depicts one embodiment of a reconfigurable container-closure system in a first configuration.
Figure 2:
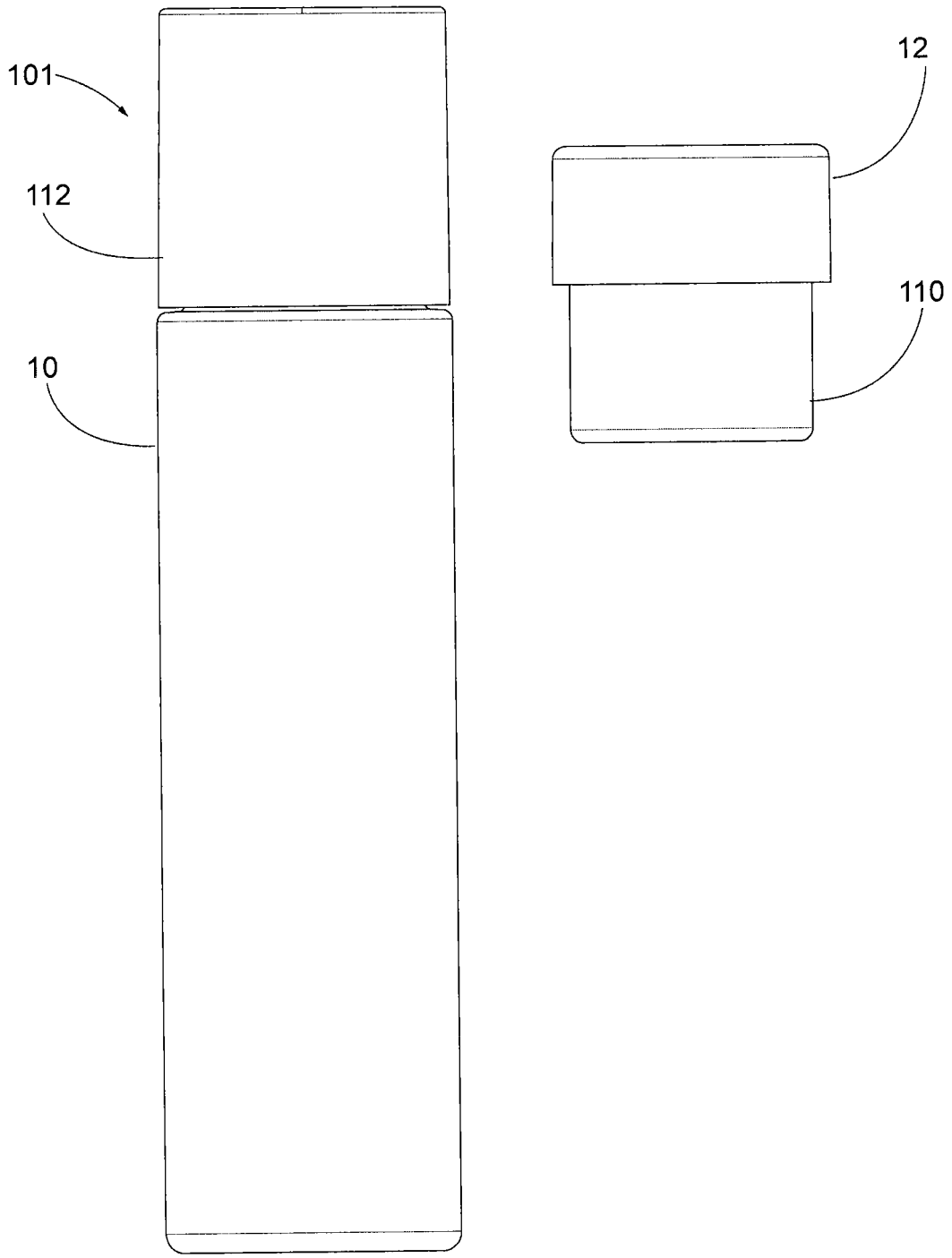
FIG. 2 depicts the reconfigurable container closure system of FIG. 1 in a second configuration.

A reconfigurable container-closure system according to the invention is comprised of first (10) and second (110) containers and first (12) and second (112) closures. The container-closure system can assume either of two configurations. First configuration (1) means that the first closure is secured to the first container, and the second closure is secured to the second container. One embodiment of this is depicted in FIG. 1. Second configuration (101) means that the second closure is secured to the first container, and the first closure is free to be secured to the second container. One embodiment of this is depicted in FIG. 2. In the first configuration, two products are separated. In the second configuration, two products are allowed to mix and be dispensed.

First Configuration

The left side of FIG. 1 depicts a first closure (12) secured to a first container (10).

Details of these components are given in FIGS. 3-6.

The first container (10) has a closed bottom end (10*a*), and an opened top end (10*b*). The opened top end of the first container may be configured as a neck (10*c*). The opened top end defines an orifice (10*d*) that leads into a first reservoir (10*e*) that is suitable for containing a first product (20). The neck comprises screw threads (10*f*), and the top of the neck comprises a circular lip (10*g*; best seen in FIG. 5). The top of the circular lip flares outwardly, which will enable an orifice reducer (113; more below) to fasten to the first container (10).

Figure 6:
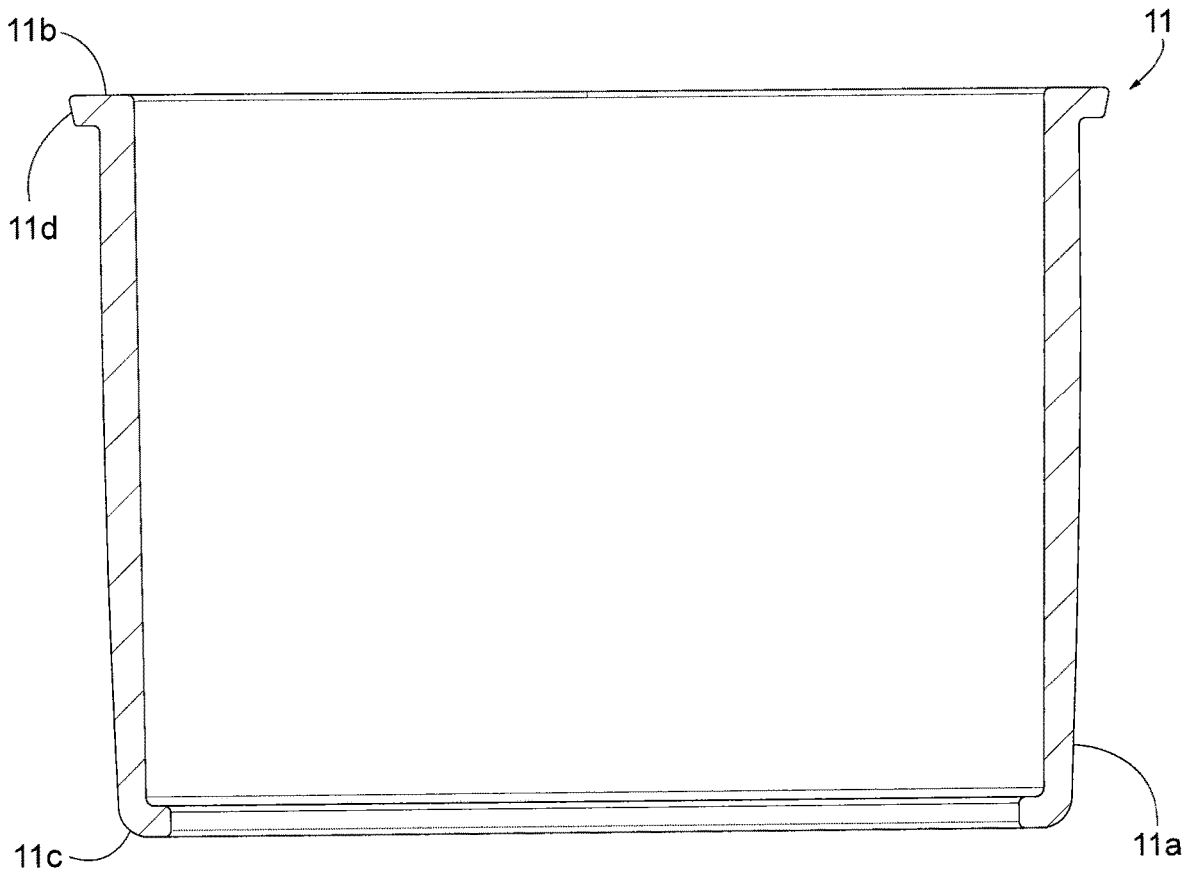
FIG. 6 depicts the plug of the first container of FIG. 4.

A plug (11) is positioned in the orifice (10*d*) of the first container (10), and has an interference fit with the interior walls of the neck (10*c*). This interference fit is sufficient to prevent the plug from coming out of the first container during intended use of the system, as well as aiding to seal the container. Referring to FIG. 6, the plug is cylindrical, and has an opened bottom end (11*a*) and an opened top end (11*b*). The bottom end is formed with a turned in step (11*c*), and the top end is formed with an outwardly directed flange (11*d*). When the plug is positioned in the orifice (10*d*), then the flange (11*d*) rests on the top of the neck (10*c*), but does not protrude laterally beyond the circular lip (10*g*). The purpose of the plug will be discussed below in connection with the piston (115).

Referring again to FIGS. 3 and 4, the first closure (12) comprises an opened bottom end (12*a*), a closed top surface (12*b*), and side wall (12*d*). The interior of the side wall supports screw threads (12*f*) that are sized to cooperate with the screw threads (10*f*) of the first container (10). A liner (12*c*) may be positioned inside the closure to form a seal against the outwardly directed flange (11*d*) of the plug (11) when the first closure (12) is screwed all the way onto the first container (10). Preferably, the liner cannot back out of the first closure. Typically, the liner may glued into the first closure. Optionally, the first closure may comprise an overshell (not shown), as is common in the art.

Figure 3:
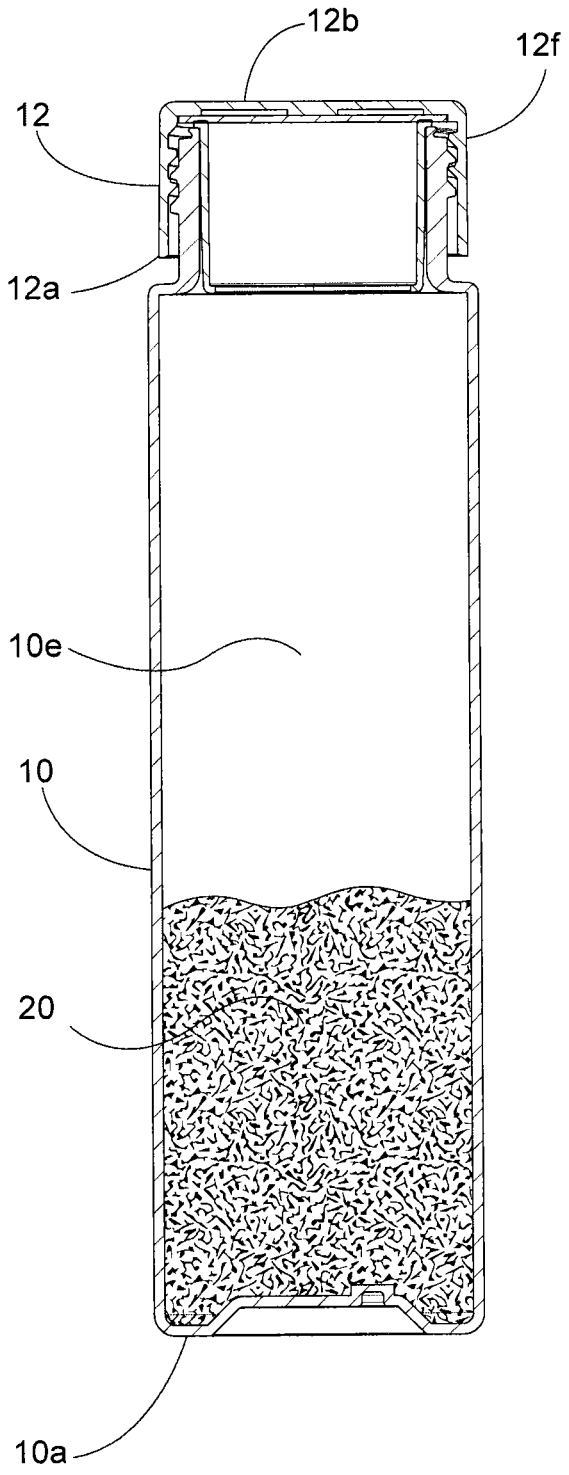
FIG. 3 is a cross sectional elevation of a first container and first closure corresponding to the left side of FIG. 1.
Figure 4:
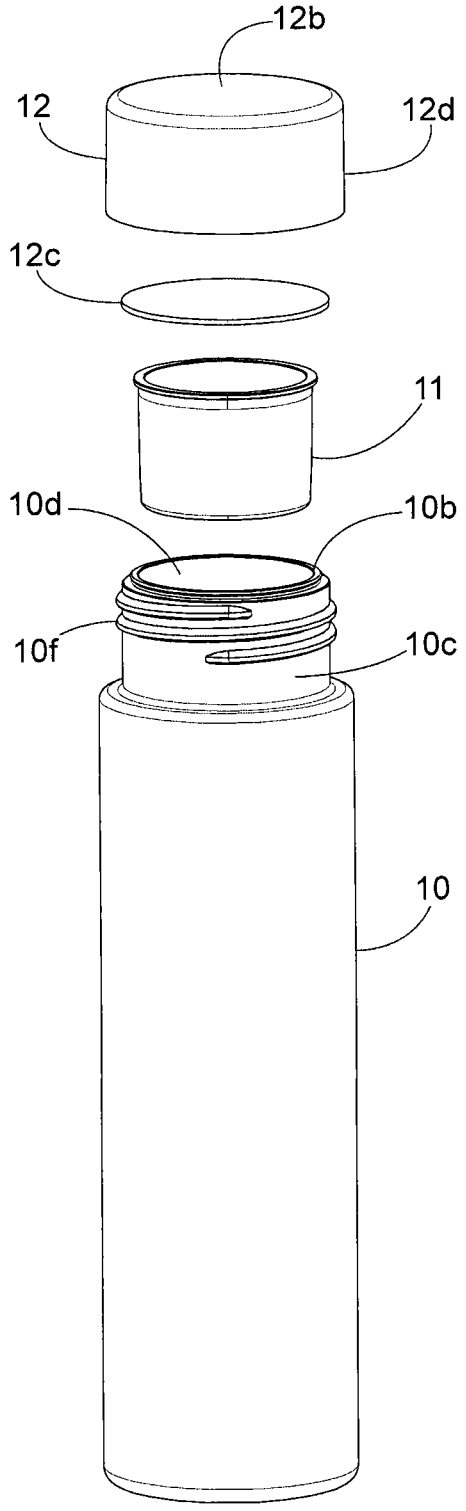
FIG. 4 is an exploded view of the embodiment of FIG. 3.
Figure 5:
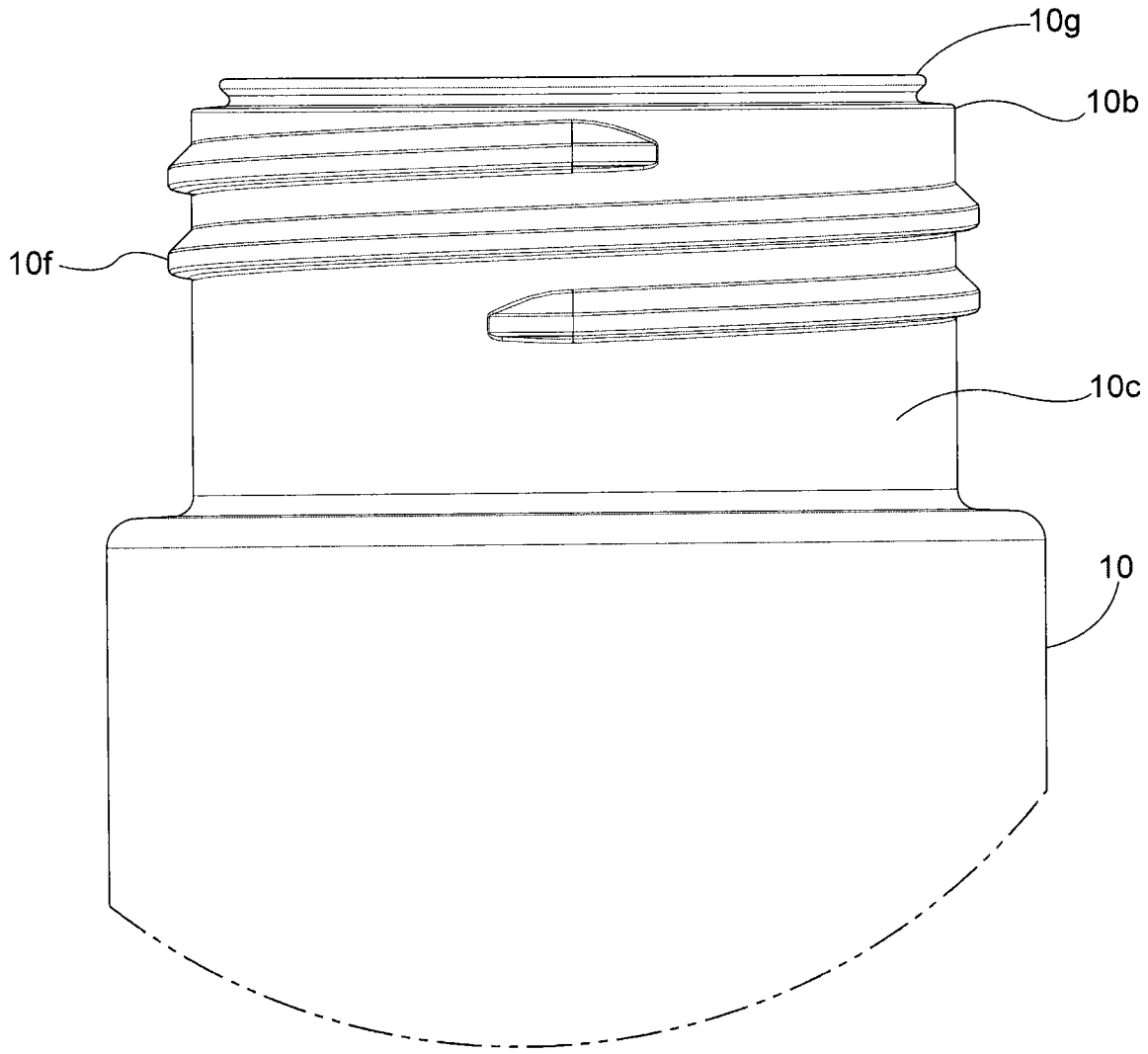
FIG. 5 is a detail view of the upper section of the first container of FIG. 4.

When the screw threads (12*f*) of the first closure are screwed down onto the screw threads (10*f*) of the first container (10), the assemblage is depicted by FIG. 3. The first container may be filled with a first product (20) in the usual manner of filling screw-capped containers. The plug (11) can be mounted to the first container either before or after filling. Preferably, the first product (20) is readily flowable and able to be efficiently mixed with the second product (120); by shaking, for example.

The right side of FIG. 1 depicts a second closure (112) secured to a second container (110). Details of these components are given in FIGS. 7-12B. The second container (110) has a closed bottom end (110*a*), and an opened top end (110*b*). Preferably, the opened top end of the second container is configured as a wide mouth that defines an orifice (110*d*). The orifice leads into the interior (110*e*) of the second container. The opened top end of the second container comprises screw threads (110*f*).

Figure 9:
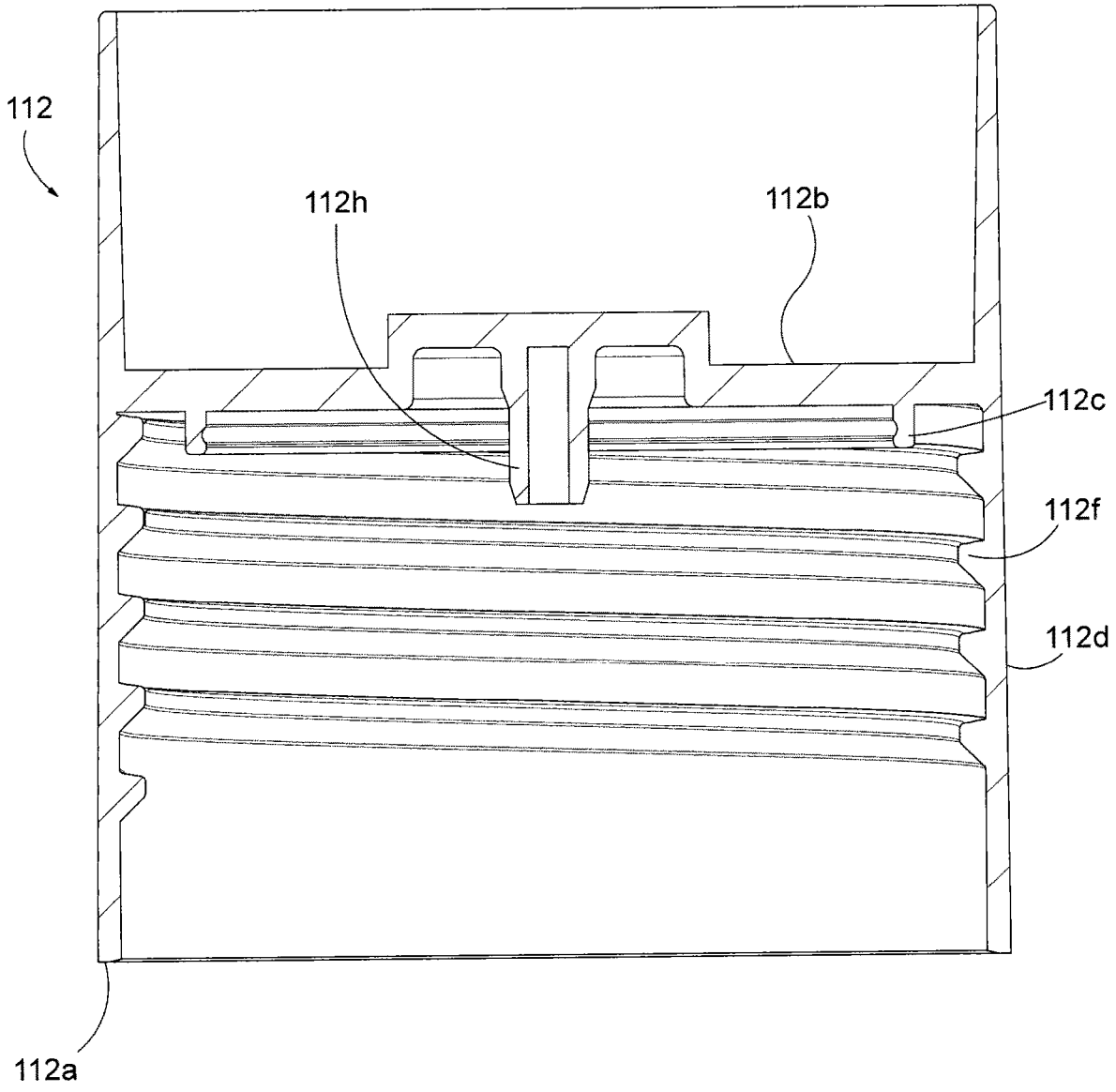
FIG. 9 is a cross-sectional view of the second closure as seen in FIGS. 7 and 8.

Referring to FIG. 9, the second closure (112) comprises an opened bottom end (112*a*), a closed top surface (112*b*), and side wall (112*d*). The interior of the side wall supports screw threads (112*f*) that are sized to cooperate with the screw threads (110*f*) of the second container (110) to close the second container. Optionally, the second closure may comprise an overshell (112*k*). In general, there is a second reservoir that is suitable for containing a second product (120), and this second reservoir is removably suspended from the second closure. Described now, is one preferred embodiment of the second reservoir, and a means for removably attaching the second reservoir to the second closure. In this preferred embodiment, the second reservoir (114*e*) is defined by an orifice reducer (113), a cartridge (114) and a piston (115). Also, a grooved ring (112*c*) and a sealing plug (112*h*) depend from the underside of the closed top surface (112*b*) of the second closure. The orifice reducer is removably suspended from the grooved ring and sealing plug of the second closure, which is now described.

Figure 10A:
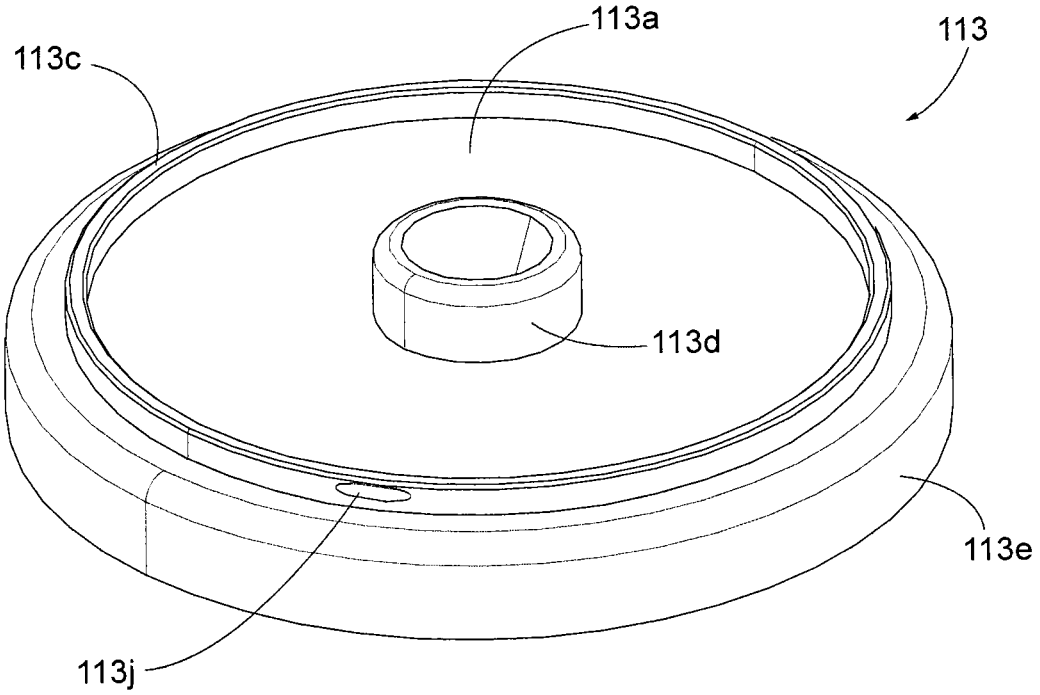
FIG. 10A is a perspective view of an orifice reducer as seen in FIGS. 7 and 8.
Figure 10B:
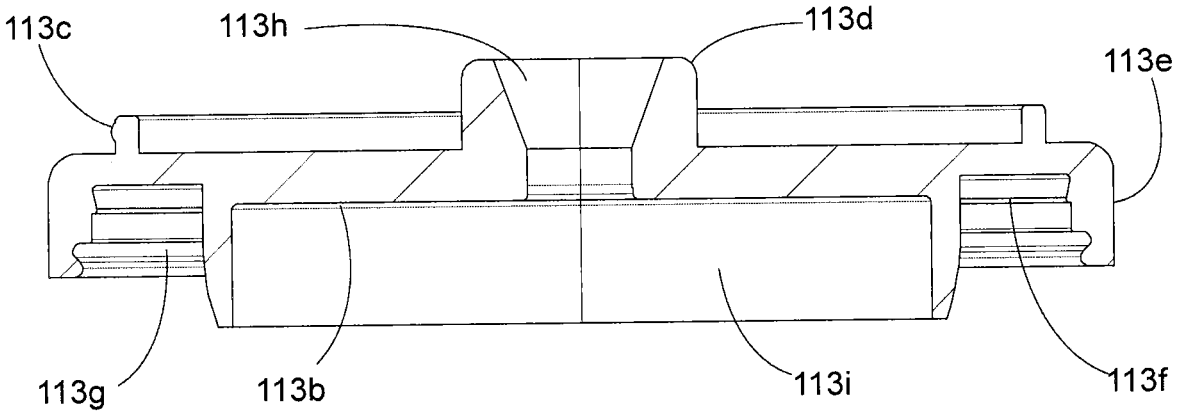
FIG. 10B is a cross-sectional view of the orifice reducer of FIG. 10A.

Referring to FIGS. 10A and 10B, an orifice reducer (113) features a top surface (113*a*) and a bottom surface (113*b*). Rising from the top surface are an upper circumferential bead (113*c*) and a cylindrical wall (113*d*). The cylindrical wall defines a passage (113*h*) through the orifice reducer. In the first configuration of the container closure system, the orifice reducer is not attached to either the first container (10) or second container (110). Rather, in a first configuration, the orifice reducer is suspended in the second closure (112) as follows. The grooved ring (112*c*) that depends from the underside of the closed top surface (112*b*) of the second closure is designed to receive one or more bumps (113*j*) located on the upper circumferential bead (113*c*) of the orifice reducer in a snap-fit relationship. Also, the sealing plug (112*h*) is designed to make an interference fit in the passage (113*h*) of the cylindrical wall (113*d*). In this way, the orifice reducer (113) is initially mounted inside the second closure (112). The orifice reducer further comprises a side wall (113*e*) that depends from the bottom surface (113*b*) of the orifice reducer. The side wall has an upper groove (113*f*) and a lower groove (113*g*). Concentric with the side wall of the orifice reducer is a stovepipe feature (113*i*). The upper groove and stovepipe features are for attaching a cartridge (114), as now discussed.

Figure 11:
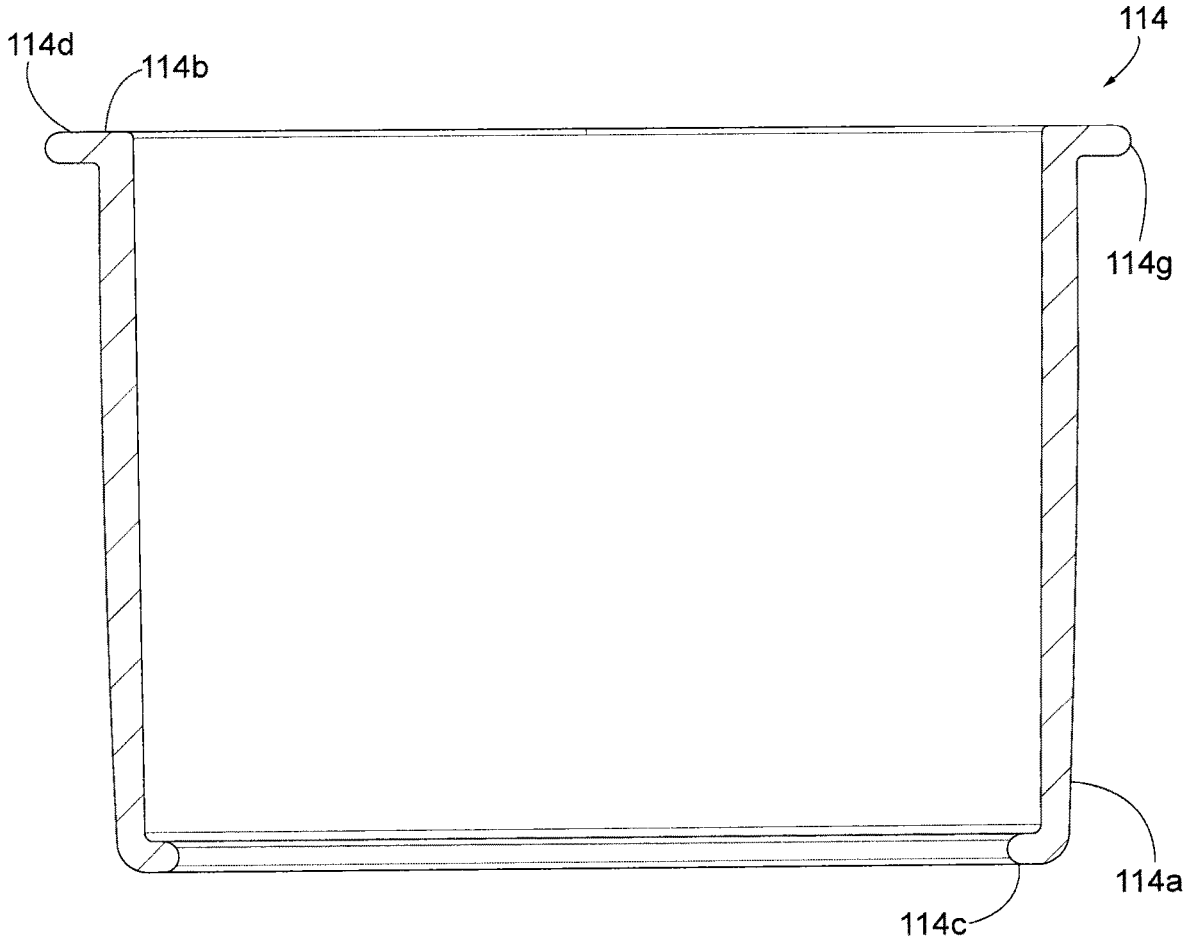
FIG. 11 is a cross-sectional view of the cartridge shown in FIGS. 7 and 8.

Referring to FIG. 11, a cartridge (114) is formed with an opened top end (114*b*) that comprises an outwardly directed flange (114*d*). The perimeter of the flange bears a circumferential bead (114*g*), which is positioned to be received into the upper groove (113*f*) of the orifice reducer, in a snap-fit engagement. Thus, the cartridge (114) is initially mounted to the second closure (112), by way of the orifice reducer (113). The cartridge also comprises an opened bottom end (114*a*) that has a lower bead (114*c*) along its perimeter. This bead is for securing a piston (115) in its initial position, as now discussed.

Figure 12A:
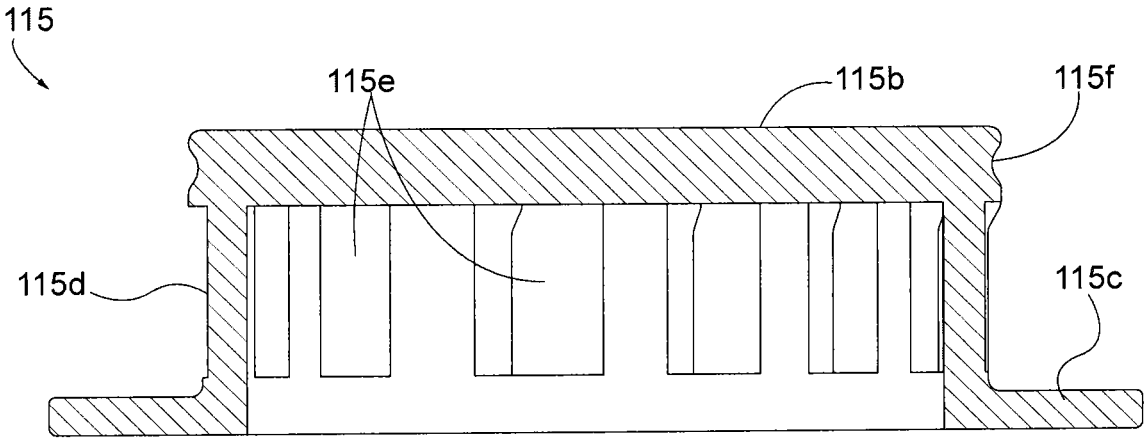
FIG. 12A is a cross-sectional view of a piston as seen in FIGS. 7 and 8.
Figure 12B:
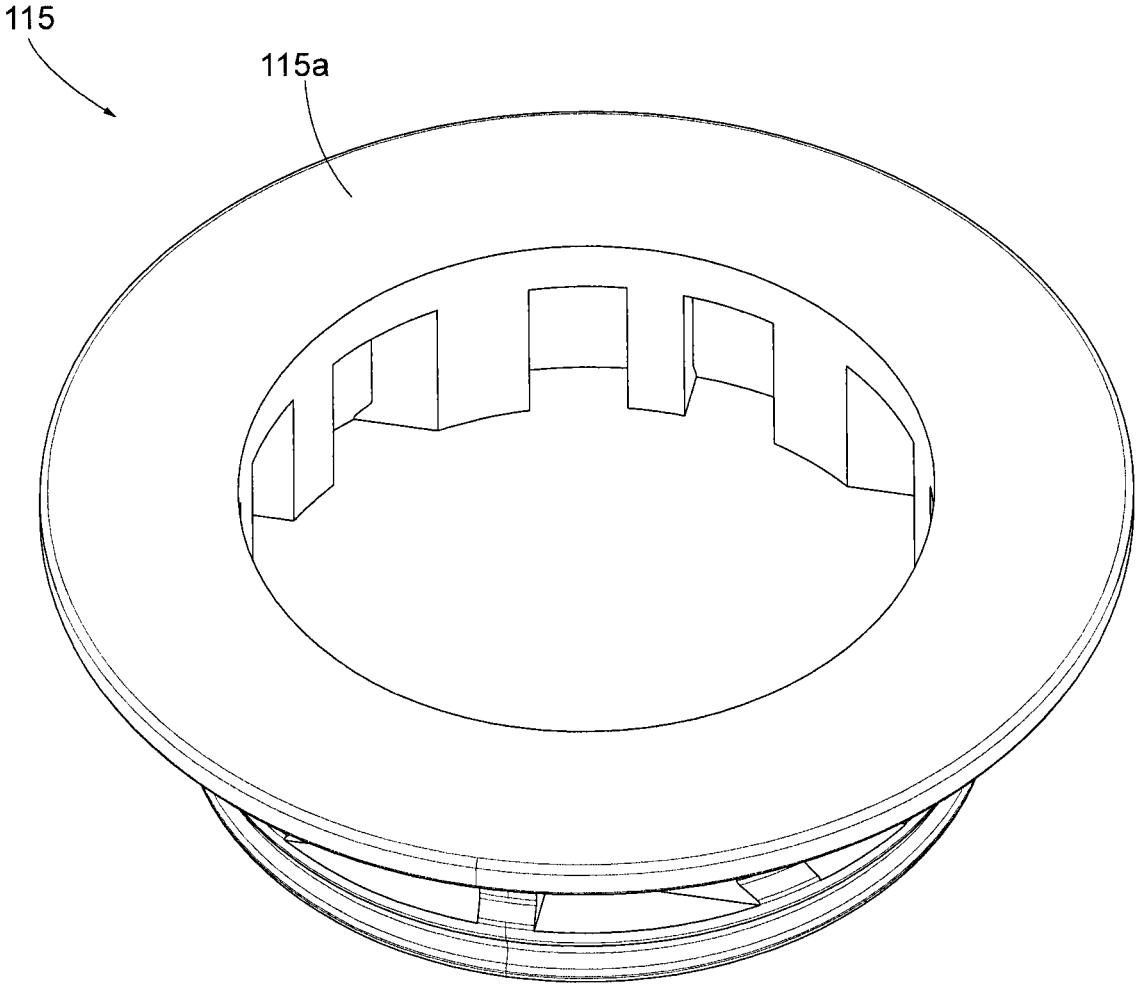
FIG. 12B is a perspective view of the piston of FIG. 12A.

A piston (115) is shown right-side up in FIG. 12A, and up-side down in FIG. 12B. The piston is comprised of an opened bottom end (115*a*), a closed top end (115*b*) and a side wall (115*d*). The opened bottom end supports an outwardly directed flange (115*c*), and the side wall has one or more slots (115*e*) that pass completely through the side wall. A circumferential groove (115*f*) near the closed top end is positioned to receive the lower bead (114*c*) of the cartridge (114). When the lower bead (114*c*) is positioned in the circumferential groove (115*f*), then the piston (115) is in its initial position relative to the cartridge.

When fully assembled, the bottom end (114*a*) of the cartridge is sealed off by the piston, and the top end of the cartridge is sealed off by the orifice reducer and the sealing plug (112*h*) of the second closure. In this way, a second reservoir (114*e*) inside the cartridge, is defined. This second reservoir is suitable for containing a second product (120). In the first configuration of the present container-closure system, the second product is sealed within the second reservoir. Furthermore, this second reservoir initially depends from the second closure (112), but is removable from the second closure by detaching the orifice reducer (113) from the second closure.

The second reservoir (114*e*) may be filled as follows. A piston (115) is first secured to the cartridge (114), as described above. Product is then filled into the second reservoir through the opened top end (114*b*) of the cartridge. An orifice reducer (113) is then attached to the top of the filled cartridge, and the orifice reducer is mounted into a second closure (112), as described above. Alternatively, the second closure, orifice reducer and cartridge could be assembled, as described above. Then, product could be filled into the second reservoir through the opened bottom end (114*a*) of the cartridge, and then the piston could be fitted to the cartridge, as described above.

Figure 7:
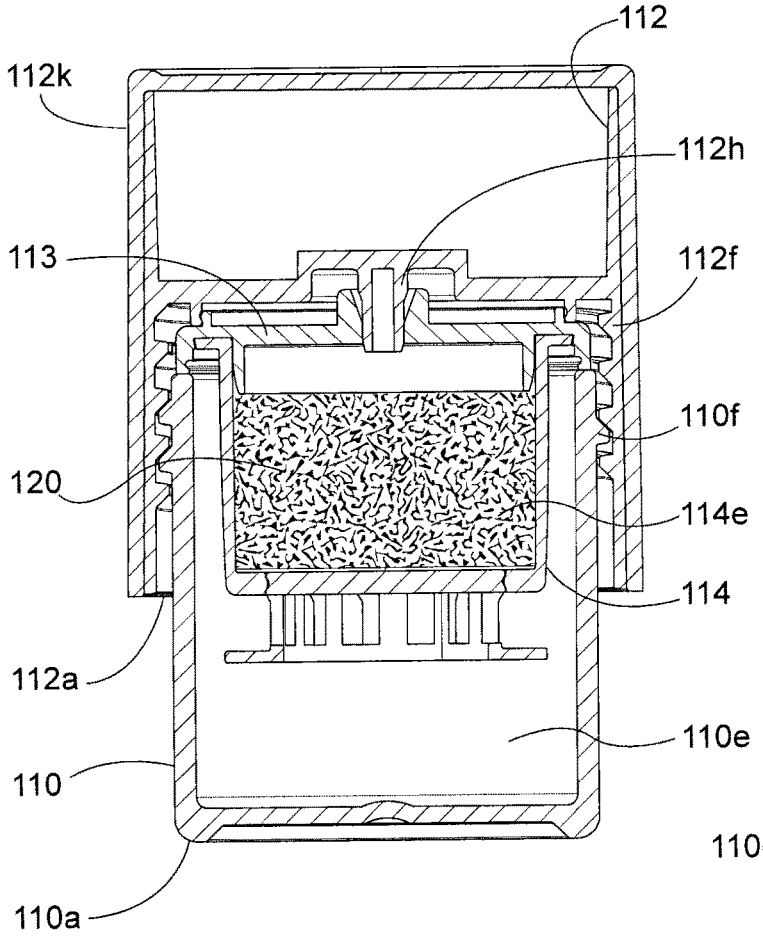
FIG. 7 is a cross sectional elevation of a second container and second closure corresponding to the right side of FIG. 1.
Figure 8:
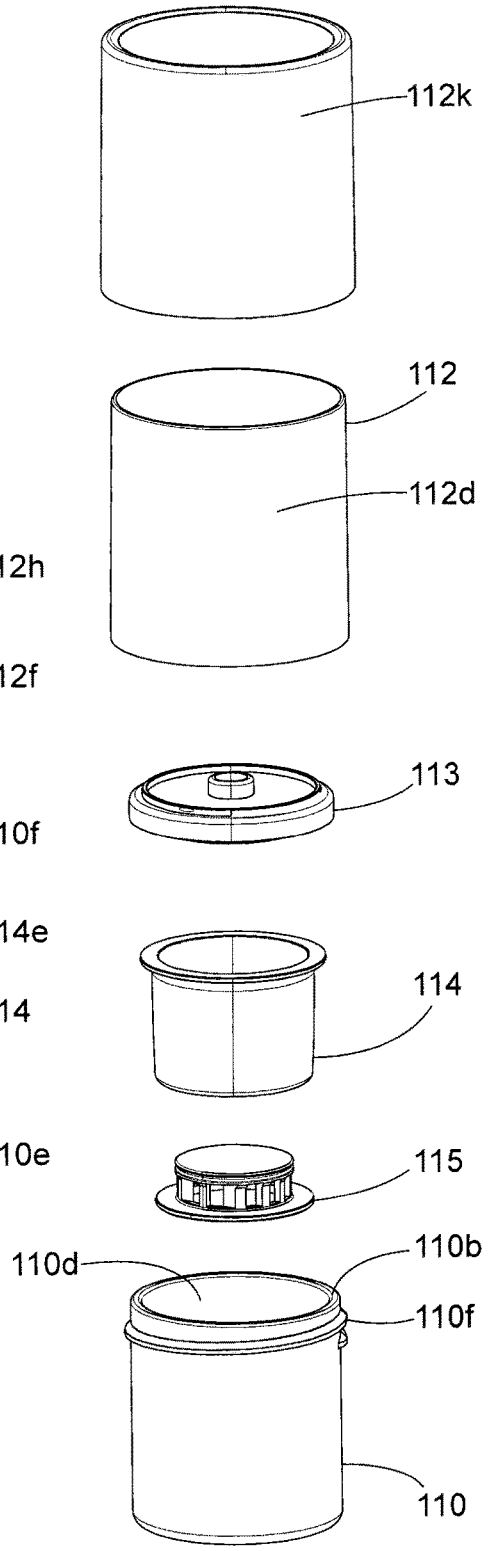
FIG. 8 is an exploded view of the embodiment of FIG. 7.

The screw threads (112*f*) of the second closure (112) may be screwed down onto the screw threads (110*f*) of the second container (110), until the side wall (113*e*) of the orifice reducer (113) contacts the top end (110*b*) of the second container. This is depicted in FIG. 7. Generally, this arrangement is not expected to create a fluid tight seal, but this contact does not have to produce a fluid tight seal, because all of the flowable product is contained within the second reservoir (114*e*), and not directly in the internal space (110*e*) of the second container.

The reconfigurable container-closure system of the present invention is capable of a first configuration (1) and a second configuration (101). First configuration of the system means that the first closure (12) is mounted onto the first container (10) by means of the cooperating threads (10*f* and 12*f*). In this arrangement, a first product (20) located in the first reservoir (10*e*) of the first container (10) is protected from the ambient environment, and is unable to mix with a second product (120). First configuration also means that the second closure (112) is mounted onto the second container (110) by means of the cooperating threads (110*f* and 112*f*). In this configuration, a second product (120) located in the second reservoir (114*e*) of the cartridge (114) is protected from the ambient environment, and is unable to mix with the first product (20). In first configuration, the second container protects the second reservoir prior to first use. This is the configuration of the system as it is provided to a consumer. However, as we will see, at the time of first use, a user will transfer the second reservoir from the second closure, and attach it to the first container (110). This will create a second configuration (101) of the system.

Second Configuration and Use of the System

When a consumer wants to use the product for the first time, he/she removes the first closure (12) from the first container (10), and the second closure (112) from the second container (110). At this point, the second container is clean and empty. By design, the second closure is able to form a fluid tight seal with the first container. For example, the screw threads (112*f*) of the second closure are sized to work with the screw threads (10*f*) of the first container to create a sealing engagement. Likewise, the first closure is able to form a fluid tight seal with the second container. For example, the screw threads (12*f*) of the first closure necessarily work with the screw threads (110*f*) of the second container to create a sealing engagement between the liner (12*c*) and the top end (110*b*) of the second container.

Figure 13:
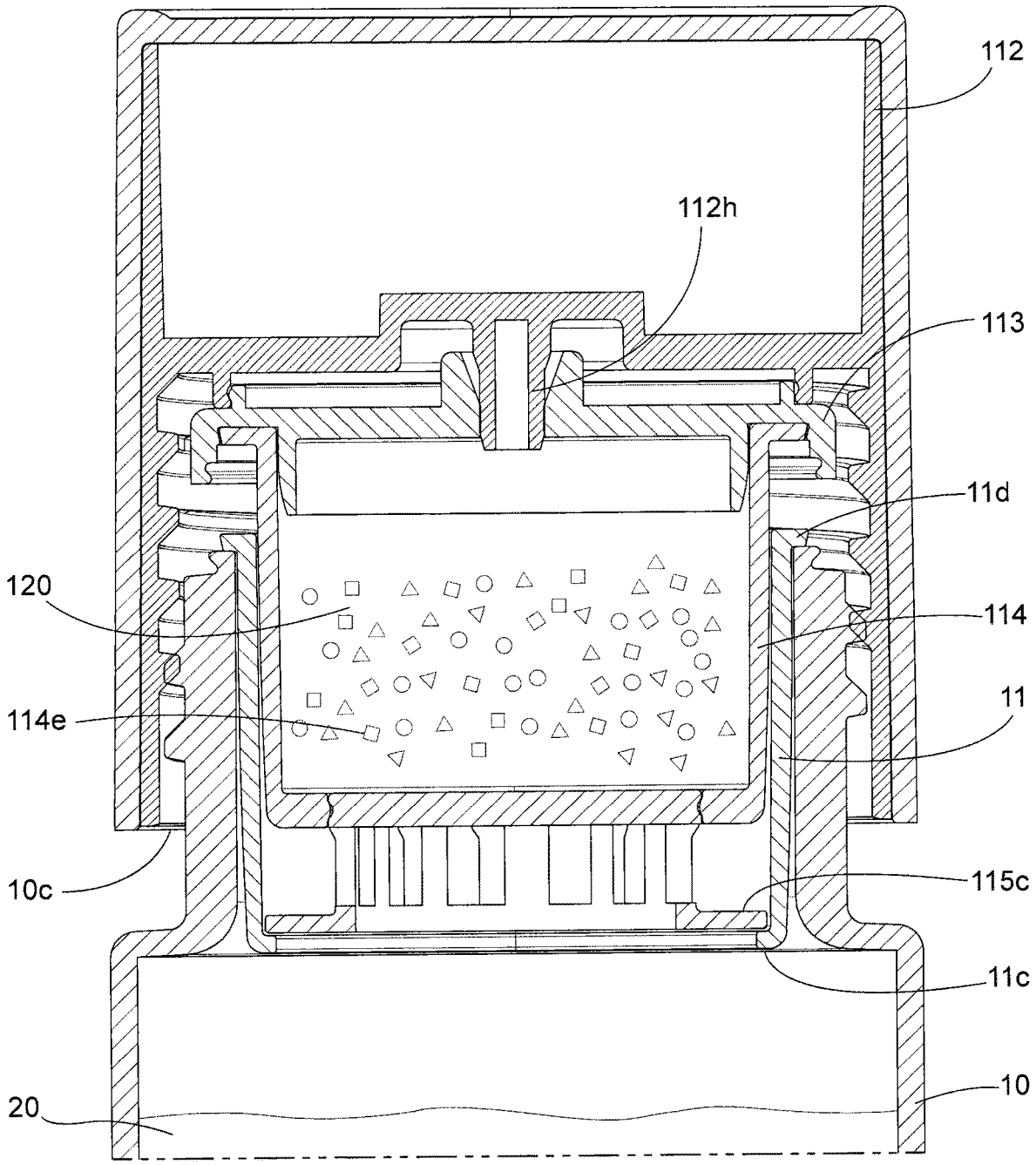
FIG. 13 is a cross sectional elevation of the second closure partially seated on the first container.

Referring to FIG. 13, the user applies the second closure (112) to the first container (10) by inserting the lower portion of the second reservoir (114*e*) into the plug (11) which sits in the neck (10*c*) of the first container. As the user begins to screw down the second closure, the flange (115*c*) of the piston will come to rest against the turned in step (11*c*) at the opened bottom end (11*a*) of the plug.

Figure 14:
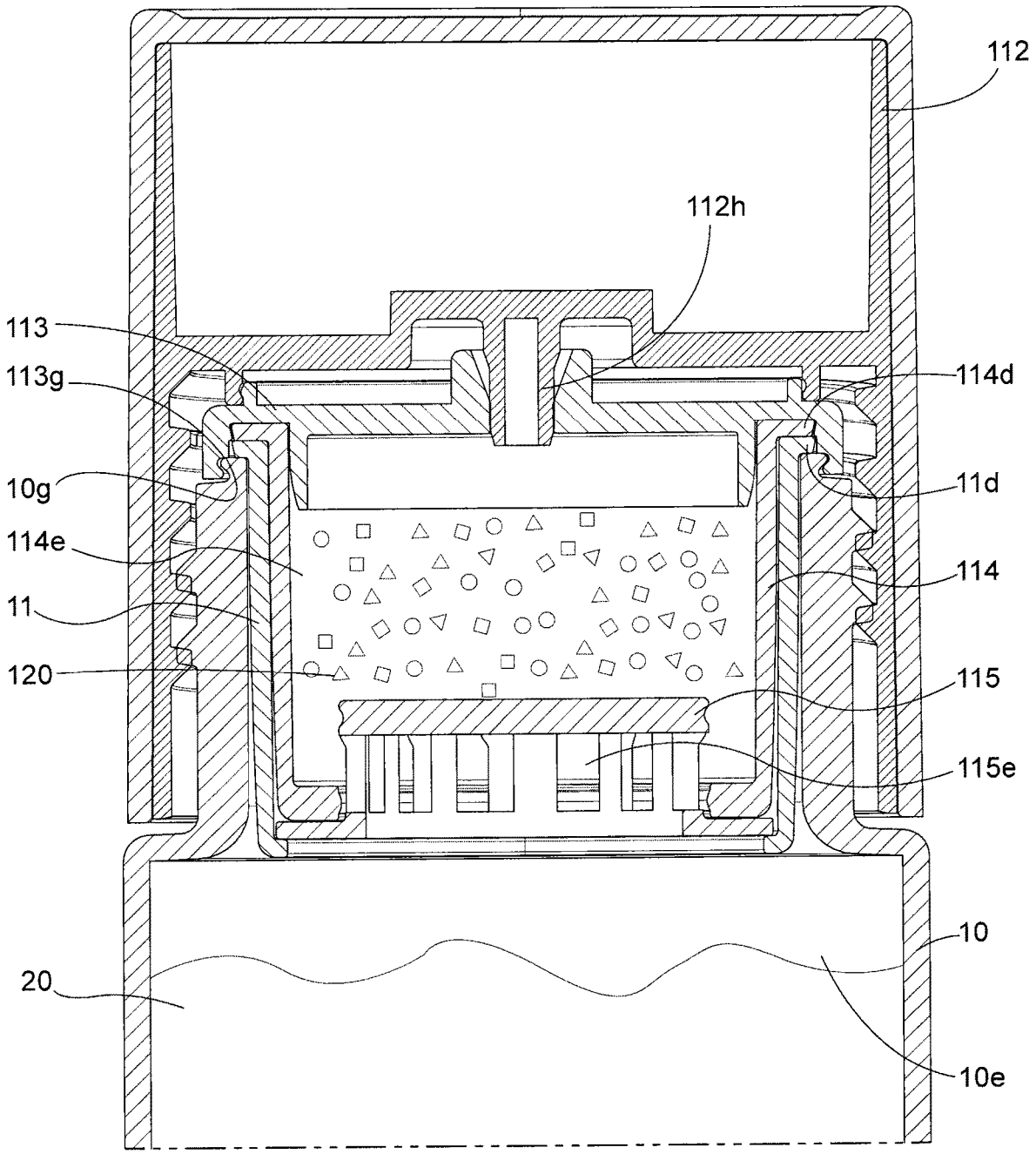
FIG. 14 is corresponds to FIG. 13, wherein the second closure is fully seated on the first container, corresponding to the right side of FIG. 2.

Referring to FIG. 14, as the user continues to screw the second closure (112) down onto the first container (10), the cartridge (114) and piston (115) will separate, thus unsealing or opening the second reservoir (114*e*). The cartridge will travel downward relative to the piston, until the opened bottom end (114*a*) of the cartridge comes to rest against the flange (115*c*) of the piston. The piston is now trapped between the cartridge and the plug, and can no longer move.

Simultaneously, the outwardly directed flange (114*d*) at the opened top end (114*b*) of the cartridge (114) will come to rest against the outwardly directed flange (11*d*) at the opened top end (11*b*) of the plug (11). Also simultaneously, the lower groove (113*g*) of the orifice reducer (113) will engage the circular lip (log) on the neck (10*c*) of the first container (10). By design, this engagement is stronger than that between the orifice reducer and second closure.

At this point, if the product (120) in the second reservoir (114*e*) is flowable, the slots (115*e*) in the piston will allow the second product to fall down into the first reservoir (10*e*) and mix with the first product (20).

Except for some slight additional tightening, the second closure (112) is fully seated on the first container (10), and the first container is sealed against the ambient environment. The top of the second reservoir is still sealed off by the orifice reducer (113) and sealing plug (112*h*). The flange (115*d*) of the piston (115) bears down against the top of the neck (10*c*) to create a seal, and preferably, the plug (11) makes an interference fit within the neck of the first container. At this point, by shaking or inverting the first container, the first product is able to flow into the second reservoir and interact with the second product. This may be necessary if the second product is not flowable or cannot escape from the second reservoir.

To dispense the mixed product combination, a user removes the second closure (112) from the first container (110). When the second closure is removed from the first container, the second reservoir (114*e*) detaches from the second closure and remains attached to the first container. For example, as a user unscrews the second closure (112) from the first container (10), the orifice reducer (113) detaches from the second closure, because it is held more firmly by the circular lip (10*g*) on the first container (10). Thereafter, the orifice reducer, cartridge and piston remain fixed on the first container. The user dispenses product through the passage (113*h*) of the orifice reducer. Depending on the diameter of the passage, dispensing may be by shaking or pouring.

Figure 15:
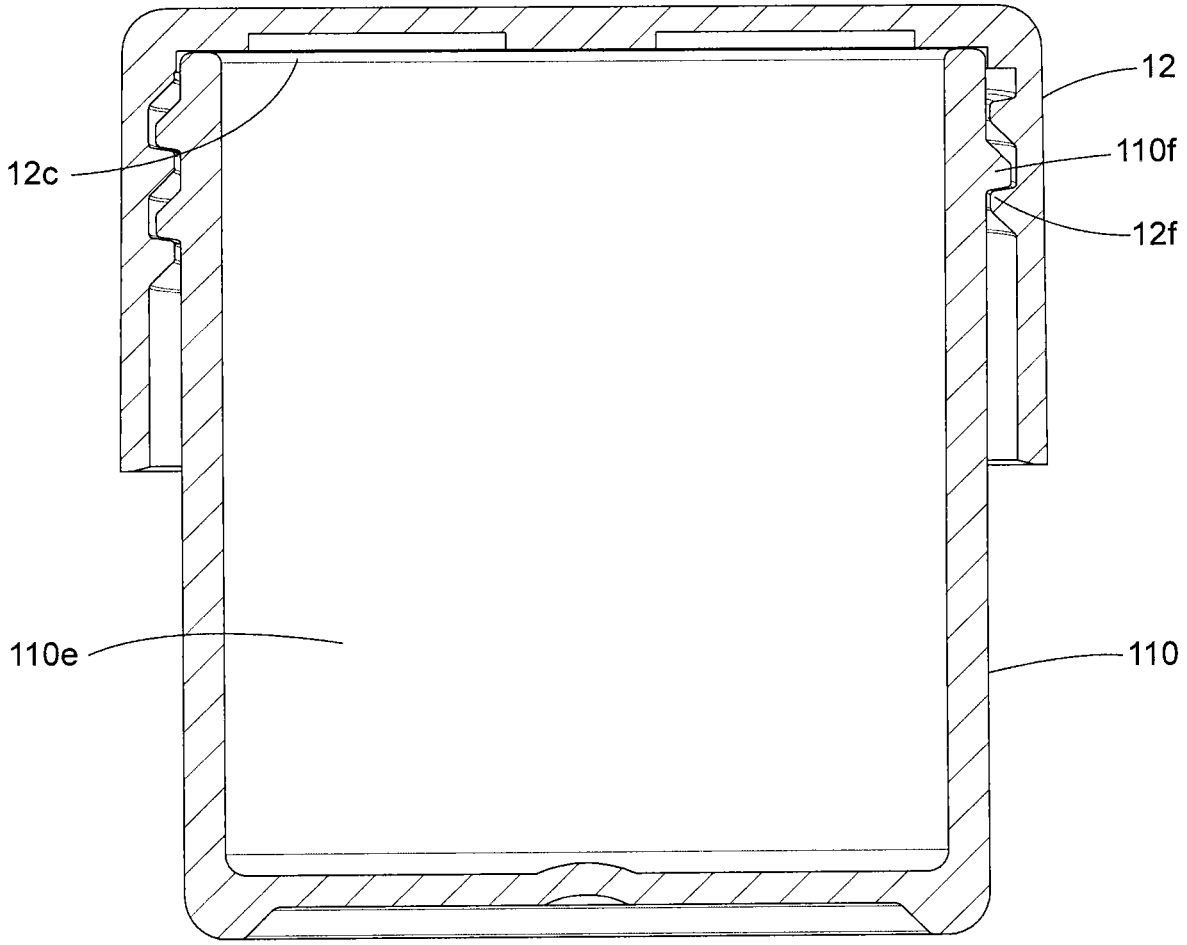
FIG. 15 is a cross sectional elevation of the first closure secured to the second container, corresponding to the right side of FIG. 2.

Furthermore, the second container (110) is clean, its interior (110*e*) never having been exposed to the second product (120), and the first closure (12) necessarily fits onto the second container, as shown in FIG. 15. The liner (12*c*) of the first closure may have contacted the first product (20), but the liner may be easily cleaned, so that the present invention includes an auxiliary container for the consumer's use, for any purpose. For example, this auxiliary container and closure will typically be smaller than the primary container and closure, and may be used for travel.

Thus, the second configuration (101) of the present container-closure system comprises the second closure (112) mounted on the first container (10), where the first and second products are free to mix (as shown in FIG. 14), and the first closure (12) is free to be mounted on the second container (110), as shown in FIG. 15.

As we noted above, in the first configuration of the system, the orifice reducer (113), cartridge (114) and piston (115) are attached to the second closure (112), while in the second configuration they are attached to the first container (110). The transfer is accomplished by a user who simply screws the second closure onto the first container. Because the orifice reducer cartridge and piston are now attached to the first container, the system cannot go back to its first configuration, and once the second reservoir (114*e*) has been opened, it cannot be closed again.

What is claimed is:

1. A reconfigurable container-closure system that comprises:

a first container (10) that has a first reservoir (10*e*) with a first flowable product (20) located therein;

a second container (110);

a first closure (12) that is able to form a fluid tight seal with the first container (10) and with the second container (110);

a second closure (112) that is sized to engage the second container (110), as well as form a fluid tight seal with the first container (10);

a second reservoir (114*e*) removably attached to the second closure (112) and having a second flowable product (120) located therein;

wherein:

when the second closure (112) forms a fluid tight seal with the first container (10), then the second reservoir is opened; and when the second closure (112) is removed from the first container (10), then the second reservoir (114*e*) detaches from the second closure and remains attached to the first container.

2. A reconfigurable container-closure system that is able to assume a first configuration and a second configuration, wherein:

in the first configuration:

a first closure (12) forms a fluid tight seal with a first container (10);

the first container comprises a first reservoir (10*e*) and a first flowable product (20) is located in the first reservoir;

a second closure (112) is mounted to a second container (110);

a second reservoir (114*e*) is removably attached to the second closure, and a second flowable product (120) is sealed within the second reservoir, unable to mix with the first product;

in the second configuration:

the second closure (112) forms a fluid tight seal with the first container (10), the first closure (12) having been removed from the first container;

the second reservoir (114*e*) is attached to the first container (10); and the second reservoir is unsealed, and the first and second products (20, 120) are free to mix.

3. A reconfigurable container-closure system that comprises:

a first container (10) that has:

a closed bottom end (10*a*), an opened top end (10*b*) configured as a neck (10*c*) that defines an orifice (10*d*) that leads into a first reservoir (10*e*) that is suitable for containing a first product (20); the neck comprising screw threads (10*f*), and the top of the neck comprises a circular lip (10*g*) that flares outwardly;

a cylindrical plug (11) that has:

an opened bottom end (11*a*) that is formed with a turned in step (11*c*), an opened top end (11*b*) that is formed with an outwardly directed flange (11*d*), such that when the plug is positioned in the orifice (10*d*) of the first container (10), then the flange (11*d*) rests on the top of the neck (10*c*);

a first closure (12) that comprises:

an opened bottom end (12*a*), a closed top surface (12*b*), and side wall (12*d*) that supports screw threads (12*f*) that are sized to cooperate with the screw threads (10*f*) of the first container (10), a second container (110) that has:

a closed bottom end (110*a*), and an opened top end (110*b*) that defines an orifice (110*d*) that leads into an interior (110*e*) of the second container; the opened top end of the second container comprising screw threads (110*f*);

a second closure (112) that comprises:

an opened bottom end (112*a*), a closed top surface (112*b*) that has a grooved ring (112*c*) and a sealing plug (112*h*) depending from an underside of the closed top surface, and a side wall (112*d*) that supports screw threads (112*f*) on its interior and that are sized to cooperate with the screw threads (1100 of the second container (110) and with the screw threads (10*f*) of the first container (10);

an orifice reducer (113) suspended from the second closure (112), and having:

a top surface (113*a*), that has:

one or more bumps (113*j*) rising from the top surface (113*a*), and received into the grooved ring (112*c*) of the second closure (112) in a snap-fit relationship; and a cylindrical wall (113*d*) rising from the top surface (113*a*), that defines a passage (113*h*) through the orifice reducer, such that the sealing plug (112*h*) of the second closure (112) makes an interference fit in the passage (113*h*) of the cylindrical wall (113*d*);

a bottom surface (113*b*) from which depend:

a side wall (113*e*) that has an upper groove (113*f*) and a lower groove (113*g*); and a stovepipe (113*i*) concentric with the side wall (113*e*);

a cartridge (114) mounted to the orifice reducer (113), and having:

an opened top end (114*b*) that comprises an outwardly directed flange (114*d*) that has a circumferential bead (114*g*) which is positioned in the upper groove (113*f*) of the orifice reducer (113) in a snap-fit engagement; and an opened bottom end (114*a*) that has a lower bead (114*c*) along its perimeter; and a piston (115) secured to the cartridge (114), and having:

an opened bottom end (115*a*) that supports an outwardly directed flange (115*c*), a closed top end (115*b*), a side wall (115*d*) that has one or more slots (115*e*) that pass completely through the side wall, and a circumferential groove (115*f*) near the closed top end (115*b*), such that the lower bead (114*c*) of the cartridge (114) is positioned in the circumferential groove (115*f*), such that:

a second reservoir (114*e*) that is suitable for containing a second product (120) is defined inside the cartridge (114), and when the second closure (112) is screwed down onto the first container (10), then the lower groove (113*g*) of the orifice reducer engages the circular lip (10*g*) on the neck (10*c*) of the first container (10).

* * * * *